US005376923A

United States Patent [19]

Kindschy

[11] Patent Number: 5,376,923

[45] Date of Patent: Dec. 27, 1994

[54] ON THE COUNTER DEACTIVATOR

[75] Inventor: John H. Kindschy, Hudson, Wis.

[73] Assignee: Minnesota Mining and Manufacturing Company, St. Paul, Minn.

[21] Appl. No.: 989,762

[22] Filed: Dec. 14, 1992

[51] Int. Cl.[5] ..... G08B 13/14

[52] U.S. Cl. ..... 340/572; 335/284; 340/551

[58] Field of Search ..... 340/572, 551; 186/68; 335/205–207, 284

[56] References Cited

U.S. PATENT DOCUMENTS

| | | | |
|---|---|---|---|
| 4,623,877 | 11/1986 | Buckens | 340/572 |
| 4,684,930 | 8/1987 | Minasy et al. | 340/551 |
| 4,692,747 | 9/1987 | Wolf | 340/572 |
| 4,728,938 | 3/1988 | Kaltner | 340/572 |
| 4,745,401 | 5/1988 | Montean | 340/572 |
| 4,870,391 | 9/1989 | Cooper | 340/572 |
| 4,967,185 | 10/1990 | Montean | 340/572 |
| 5,008,649 | 4/1991 | Klein | 340/572 |
| 5,029,291 | 7/1991 | Zhou et al. | 340/551 |
| 5,059,951 | 10/1991 | Kaltner | 340/572 |
| 5,126,720 | 6/1992 | Zhou et al. | 340/572 |
| 5,170,045 | 12/1992 | Bengtsson | 340/572 X |

FOREIGN PATENT DOCUMENTS

446910A1 9/1991 European Pat. Off. .

OTHER PUBLICATIONS

"Demag characteristics of Magnequench TM," Delcoremy Division of General Motors, 2 pages.

*Primary Examiner*—Brent Swarthout
*Assistant Examiner*—Thomas J. Mullen, Jr.
*Attorney, Agent, or Firm*—Gary L. Griswold; Walter N. Kirn; Eric D. Levinson

[57] ABSTRACT

A deactivator for magnetically altering a tag used in an electromagnetic article surveillance system. The deactivator is adapted for use in conventional, pre-existing check-out counters. An elongated cover plate is secured on top of a transition plate which spans the distance between a check-out counter conveyor belt and countertop. An elongated magnet assembly is positioned between the cover plate and the transition plate. The magnet assembly provides a magnetic field above the cover plate that is capable of deactivating a magnetically alterable tag secured to an object to be purchased as the object is passed over the cover plate from the conveyor belt to the countertop.

4 Claims, 3 Drawing Sheets

ON THE COUNTER DEACTIVATOR

FIELD OF THE INVENTION

The present invention relates to electromagnetic article surveillance (EAS) systems of the general type in which an alternating electro-magnetic field is produced in an interrogation zone and in which a tag present in the zone responds to the tag, resulting in the production of a characteristic signal which is detected and processed to create a suitable response, alarm, etc. In particular, the present invention relates to a deactivator which is adapted for use in a retail store check-out counter.

BACKGROUND OF THE INVENTION

Various techniques have been used to detect shoplifting or the unauthorized removal of objects from protected areas. U.S. Pat. No. 4,870,391 (Cooper) discloses the use of target wafers which contain an electrical circuit and are affixed to displayed objects for sale. These targets can be removed only by an authorized person using a special tool. If a patron attempts to take an object for sale out of the store before the sales clerk has removed the target wafer, the wafer's resonant circuit will be detected by a surveillance system as the patron enters an interrogation zone near the store exit, thereby setting off an alarm. The disadvantage of this system is that the sales clerk must physically remove the target wafers from every object that is to be protected, which tends to slow down the check-out process.

U.S. Pat. No. 5,029,291 (Zhou et al.) discloses a method of protecting against shoplifting in a supermarket wherein there is one interrogation zone next to every check-out counter. The patron places the merchandise to be purchased on a conveyor belt on the check-out counter which is outside of the interrogation zone. The patron must, however, push his grocery cart through an interrogation zone located adjacent the check-out counter. This system is disadvantageous in that: (1) it requires a separate interrogation zone for every check-out counter, which could require as many as 20 or more pairs of detection panels for a single store, and (2) it can be difficult to push the cart through the interrogation zone, since the already cramped spacing between adjacent grocery counters is made even more cramped by the addition of a pair of detection panels.

U.S. Pat. No. 4,684,930 (Minasy et al.) discloses the use of a freely rolling cylindrical target deactivator which is mounted in the countertop of the check-out counter. This system is disadvantageous because it requires that the target to be deactivated be placed in contact with the cylindrical deactivator. The use of the roller can slow down the check-out process, particularly if it becomes clogged over time due to repeated use. The system is also disadvantageous because it requires that the countertop of the check-out counter be cut into so as to allow the insertion of the cylindrical deactivator.

U.S. Pat. No. 5,059,951 (Kaltner) discloses the use of a deactivator that is fitted into a bar code scanner located in the countertop of the check-out counter. The deactivator includes a pair of single loop antennas which are fitted to the underside of the scanner cover. The antennas are electrically coupled to a matching circuit, which includes the circuitry necessary to develop and receive appropriate signals to deactivate a label by exposing a resonant circuit contained therein to a relatively high energy field sufficient to cause a short circuit in the resonant circuitry of the marker. A control unit provides the signals used to regulate the antenna system. These signals are conveyed by a cable which extends between a transceiver and a casing in the scanner. This system is disadvantageous because of its complexity. The system is also disadvantageous because successful deactivation of the label is dependent both on the speed with which the label is passed over the deactivator and the distance between the label and the deactivator. Thus, in order to provide appropriate assurance that the label has been deactivated, it is usually necessary to include a verification system that confirms that the label has indeed been deactivated.

It would be desirable to have a simplified deactivator which can be easily adapted to fit existing retail store check-out counters.

SUMMARY OF THE INVENTION

Accordingly, the present invention includes a deactivator for magnetically altering a tag used in an electromagnetic article surveillance system. The deactivator is adapted for use in a conventional, pre-existing check-out counter. Such check-out counters typically have a conveyor belt which transports objects to be purchased toward a cashier. Before the objects reach the cashier, they are stopped by a transition plate, where they are left within easy reach of the cashier.

The deactivator of the present invention includes a cover plate which is adapted to be secured on top of the transition plate. The cover plate contains a cavity along its length. An elongated magnet assembly is positioned in the cavity. The magnet assembly provides a magnetic field above the cover plate that is capable of deactivating a magnetically alterable tag secured to an object as the object is passed over the cover plate. The deactivator includes means for securing the cover plate to the transition plate. This allows the cashier to easily deactivate the tag as the cashier moves the object from the belt to the countertop.

In another embodiment, the deactivator of the present invention can be secured to an edge of the check-out counter. The leading edge of the cover plate has a C-shaped cross-section which allows the cover plate to be hooked onto the counter edge. The deactivator can be further secured to the counter with a double-sided pressure sensitive adhesive.

The intensity and orientation of the magnetic field provided by the magnet assembly should be matched to the characteristics of the magnetically alterable tag with which the deactivator is to be used. For example, in a preferred embodiment, such tags can include a magnetizable portion which, when magnetized, changes a detectable characteristic response of the tag, i.e., deactivates it.

BRIEF DESCRIPTION OF THE DRAWING

The present invention will be further understood with reference to the accompanying drawing wherein.

DETAILED DESCRIPTION

Figure 1:
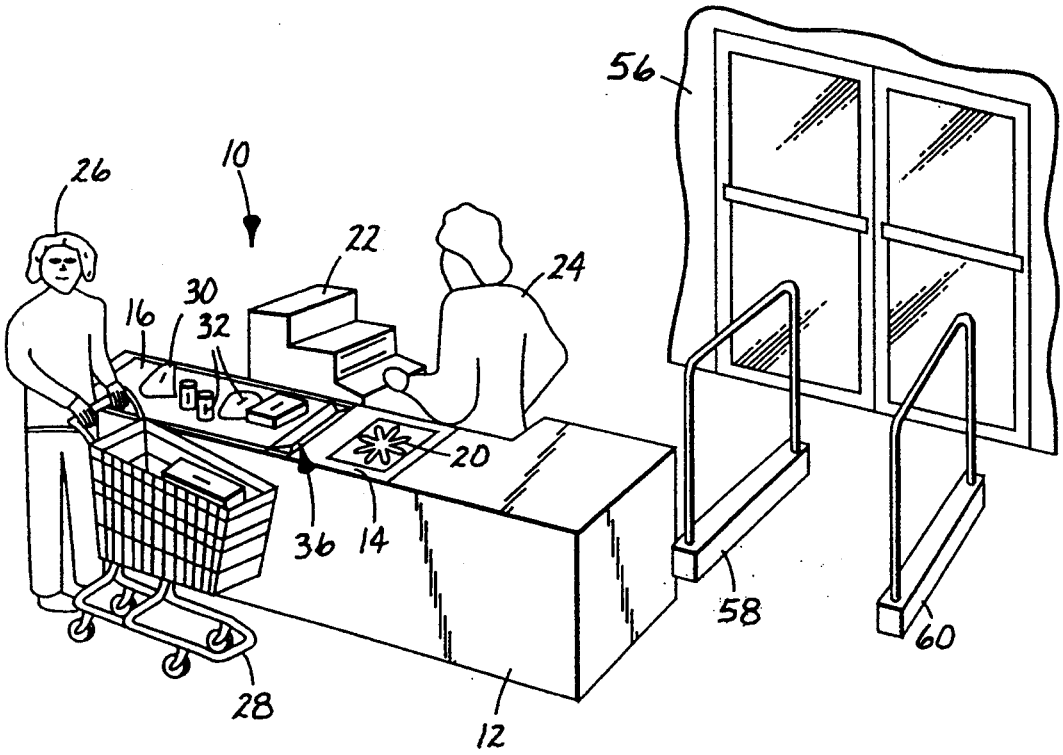
FIG. 1 is a perspective view of a retail store check-out counter using the deactivator of the present invention.
Figure 2:
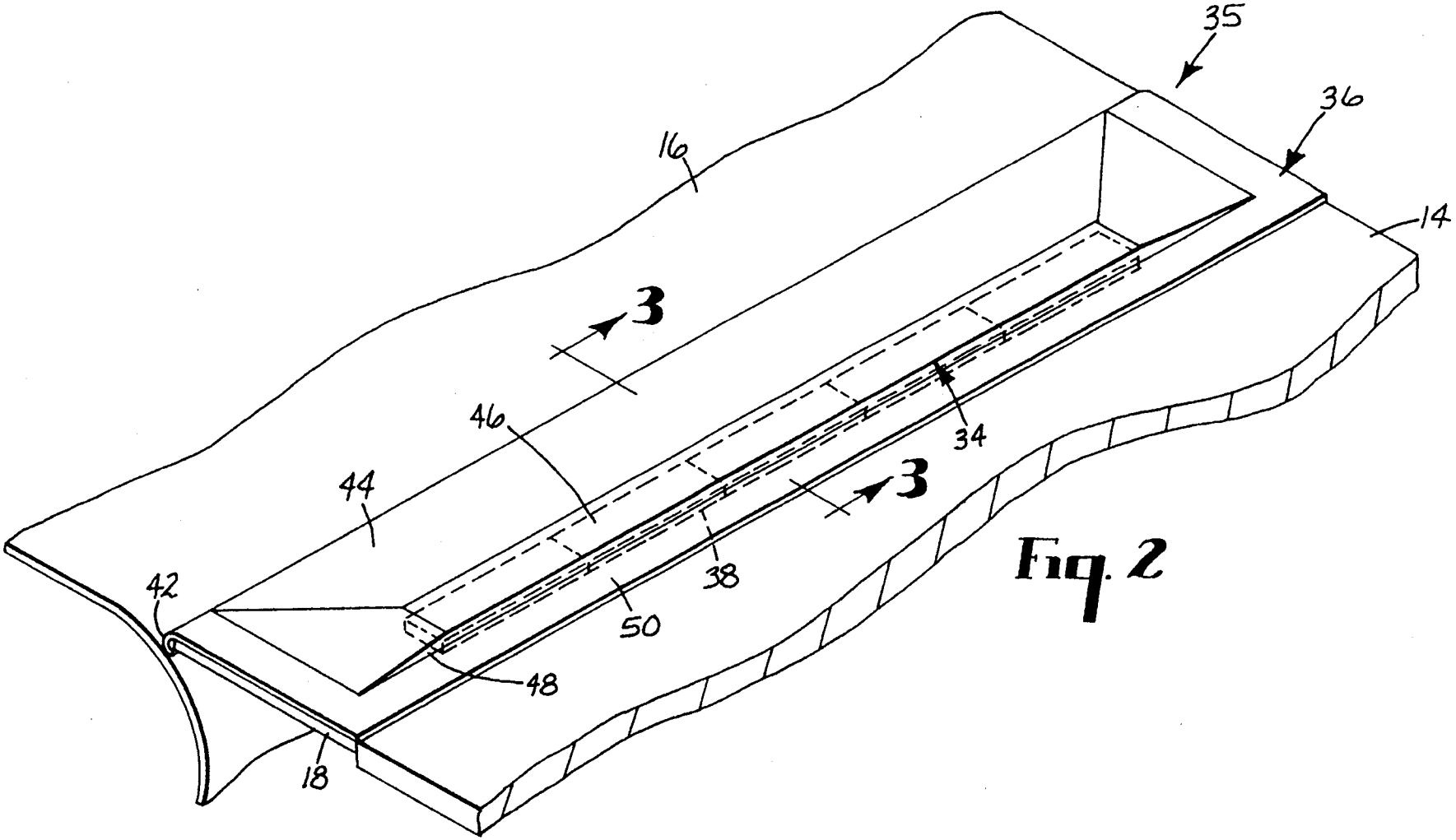
FIG. 2 is a perspective view of a deactivator according to one embodiment of the present invention.

A typical installation in which the deactivator of the present invention is to be used is shown in FIG. 1. A conventional retail store check-out counter 10 includes a housing 12, a substantially planar countertop 14, a conveyor belt 16, a portion of which is coplanar with the countertop, a transition plate 18 (as shown in FIG. 2), and an optional laser scanner 20. While the invention is shown in such an installation, it has equal utility in check-out counters in libraries, stock rooms, etc., i.e., wherever EAS systems may be employed.

As shown in greater detail in FIG. 2, a deactivator 35 has been installed on the check-out counter 10. The deactivator includes an elongated cover plate 36 and an elongated magnet assembly 34 positioned within an elongated cavity in the cover plate which extends along the length of the cover plate.

A customer 26 unloads a shopping cart 28 by placing objects 30 on the conveyor belt 16, as shown in FIG. 1. The objects 30 whose unauthorized removal is to be prevented are provided with magnetically alterable tags 32. The conveyor belt 16 conveys the objects 30 to a cashier 24 assigned to cash register 22. The cashier 24 takes objects 30 off the conveyor belt 16 and passes the objects over the magnet assembly cover plate 36 to the countertop 14. An optional laser scanner 20 in the countertop 14 automatically records the sale of objects to be purchased when they are passed over it in a manner that a bar code on the object can be seen by the scanner. In the alternative, the sale of the objects may be recorded by a hand-held scanner or by having the cashier 24 manually enter the sale price into the cash register 22.

The magnetically alterable tags 32 secured to the objects 30 are magnetized and thereby deactivated by the magnet assembly 34 secured beneath the cover plate 36. When the customer 26 completes the purchase, the customer may leave the store through exit doors 56 with the shopping cart 28 containing purchased objects 30, having deactivated tags 32 secured thereto, by first passing between spaced apart detection panels 58 and 60. However, a person who attempts to take the objects 30 bearing the tags 32 from the store without having them registered by the cashier 24, and therefore without having the tags deactivated, will activate an alarm (not shown) as the person carries the objects between the detection panels 58 and 60 in order to pass through the exit doors 56.

The tag 32 is typically constructed of an elongated strip of a high permeability, low coercive force ferromagnetic material such as permalloy, certain amorphous alloys, or the like. The strip is further provided with a plurality of high coercive force magnetizable sections. These sections are typically formed of a material such as vicalloy, arnochrome, silicon steel or the like, typically having a coercive force in the range of 50 to 240 oersteds. When such sections are magnetized, the residual fields provided thereby magnetically bias the low-coercive-force strip and substantially alter the signal response produced in the presence of an interrogating field. The magnetization of the high-coercive force magnetizable sections is effected upon passing through the fields provided by the magnet assembly 34 when those sections are brought into close proximity with the magnet assembly cover plate 36.

Preferred tags 32 include WH-0117 Whispertape TM rectangular markers and QTN Quadratag TM markers, sold by 3M Company, St. Paul, Minn., which have high coercive force magnetizable sections of 179 and 81 oersteds, respectively. Other preferred tags 32 include those disclosed in U.S. Pat. No. 4,967,185 (Montean). The tags 32 are preferably placed next to or on top of the bar code, or other pricing information, on the objects 30. The tags 32 can also include RF responsive tags which include a magnetizable element, such as is disclosed in U.S. Pat. No. 4,745,401 (Montean).

As the cashier 24 passes the object 30 to be purchased over the cover plate 36 towards the scanner 20, the cashier would ordinarily rotate the object so that its bar code is close to and faces the scanner. All that is required of the cashier 24 to deactivate the tag 32 is that the object 30 be oriented before reaching the scanner 20 such that the tag passes over and in close proximity to the cover plate 36, so that the tag will be deactivated by the magnet assembly 34 under the cover plate. This may be done easily by the cashier 24 during the routine passing of the object 30 from the conveyor belt 16 to the scanner 20.

A more detailed view of the deactivator 35 as installed in the conventional check-out counter 10 is shown in FIG. 2. The magnet assembly 34 is housed in an elongated cavity extending along the length of the cover plate 36. The cover plate 36 is preferably made of a non-magnetic, wear-resistant material, such as non-magnetic stainless steel, preferably series 304 stainless steel. The cover plate 36 is preferably aligned with and covers a substantial portion of the transition plate 18. The transition plate 18 is an elongated, usually non-magnetic plate, the length of which spans the width of the conveyor belt 16. The purpose of the transition plate 18 is to span the space between the conveyor belt 16 and the countertop 14 which results from the fact that the conveyor belt is a continuous loop which passes downward around a roller (not shown) from the plane of the countertop into the housing 12 of the check-out counter 10. The length of the cover plate 36 should extend substantially along the length of the transition plate 18, and the width of the cover plate should extend substantially along the width of the transition plate, i.e., the cover plate need not cover the entire transition plate. The magnet assembly cover plate 36 is preferably about 18 inches (46 cm) long, about 2.625 inches (6.7 cm) wide, and about 34 mils (0.86 mm) thick.

Figure 3:
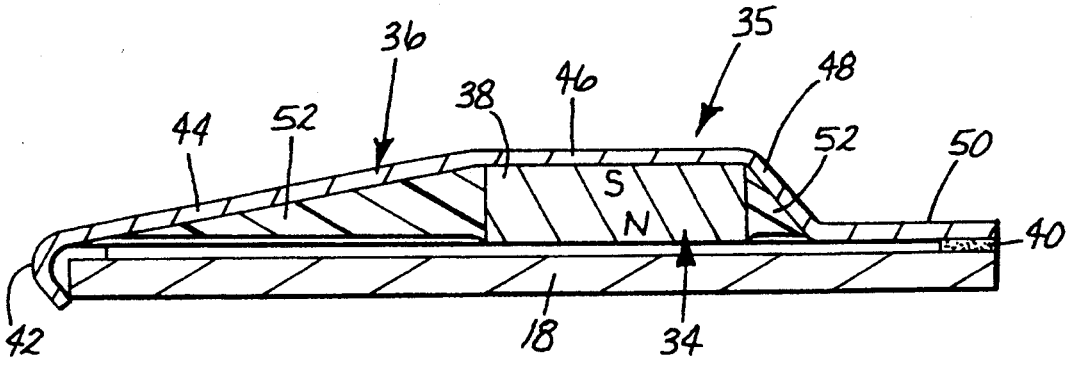
FIG. 3 is a cross-section taken along line 3—3 of the deactivator shown in FIG. 2.

The deactivator 35 is shown in cross-section in FIG. 3. The shape of the cover plate 36 will be explained with respect to FIGS. 2 and 3, where five different portions of the cover plate, each of which extends substantially along the length of the cover plate, are labeled. The first portion of the cover plate 36 is the leading edge 42 which has a C-shaped cross-section configured to allow the cover plate to be secured to the transition plate 18 by hooking the leading edge around the edge of the transition plate. This C-shaped cross section of the leading edge 42 ensures that the objects 30 can be passed over the cover plate 36 without becoming caught on the edge of the deactivator 35. In the alternative, the leading edge 42 of the cover plate 36 need not be C-shaped, and that portion of the cover plate can be secured to the transition plate 18 with an adhesive, such as a double-sided pressure sensitive adhesive. The second portion of the cover plate 36 is a gradually inclined portion 44 which is configured to allow the objects 30 bearing the magnetic tags 32 to be smoothly passed over the magnet assembly 34.

The third portion of the cover plate 36 is a parallel portion 46 that is parallel to the transition plate 18. The magnet assembly 34 can be secured inside the cover plate 36 by the use of an adhesive, such as an epoxy or double-sided pressure sensitive adhesive, placed between the magnet assembly and the parallel portion 46. As shown in FIG. 3, the magnet assembly 34 can be further secured within the cover plate 36 by the use of a filling material 52, such as Scotchcast TM opaque filler electrical resin No. 5 from 3M Company, St. Paul, Minn.

The fourth portion of the cover plate 36 is a steeply slanted portion 48 which is configured to quickly lower the level of the cover plate back to the level of the transition plate 18. The fifth portion of the cover plate 36 is the trailing edge 50 which has a short-parallel portion configured to allow the use of an adhesive 40, such as a double-sided pressure sensitive adhesive, to secure the cover plate to the transition plate 18. The same adhesive may also be used to secure both ends of the length of the cover plate 36 to the transition plate 18. A preferred adhesive 40 is a 30 mil (0.8 ram) thick very high bonding (V.H.B.) acrylic foam closed cell double-sided pressure sensitive adhesive, such as No. 4950 from 3M Company, St. Paul, Minn.

The magnet assembly 34 preferably includes a plurality of magnets 38, as shown in FIG. 2. The magnets 38 preferably have dimensions of 2.0 inches (51 mm) long by 0.675 inches (17 mm) wide by 0.225 inches (6 mm) thick. The magnets 38 are secured within the cover plate 36 so that their lengths lie along the length of the cover plate, and so that their thicknesses are perpendicular to the transition plate 18 (and the cover plate). The length of the magnet assembly 34 extends along the length of the underside of the cover plate 36 and is about three inches (7.6 cm) shorter than the cover plate, which allows for the cover plate to ramp down gradually at both ends of its length to the level of the transition plate 18. The total length of the magnet assembly 34 can vary from 10 to 22 inches (25 to 56 cm), corresponding to a row of 5 to 11 two-inch (51 ram) long magnets.

The length of the row of magnets 38 should be about as long as the scanner 20 is wide. In other words, the row of magnets 38 should be long enough that the tags 32 secured to the objects 30 will be assured of passing over the magnets as they pass over the cover plate 36.

The magnets 38 are preferably neodynium-iron-boron magnets having a magnetic energy product of about 7–9 Megagauss-Oersteds. One such magnet is Magnequench® I, available from Dexter Permag, Dexter Magnetic Materials Division, Chanhassen, Minn. Magnequench® is a registered trade name of Delco Remy Division, General Motors.

The magnets 38 are preferably oriented in the magnet assembly 34 so that their magnetization is through the thickness, i.e., the smallest dimension, of the magnets, as shown in FIG. 3. This direction of magnetization ensures that the magnets 38 will provide a substantial magnetic field over the cover plate 36 parallel to the direction of travel of the objects 30 being moved over the width of the cover plate. In the alternative, the magnets 38 can be magnetized along their width, which would also provide a magnetic field over the cover plate 36 parallel to the direction of travel of the objects 30. The intensity and orientation of the magnetic field provided by the magnet assembly 34 should be matched to the characteristics of the magnetically alterable tag 32 with which the deactivator is to be used. The strength of the magnetic field provided by the magnet assembly 34 can range from about 1100 gauss at the upper surface of the cover plate 36 to about 275 gauss at a height of ½" (1.3 cm) above the plate, to about 120 gauss at a height of about one inch (2.5 cm) above the plate.

The individual magnets 38 need not be two inches (5.1 cm) in length. For example, twice as many one inch (2.5 cm) magnets or one long magnet could be used in their place. However, the magnet assembly 34 must be able to provide a magnetic field above the cover plate 36 that is strong enough to magnetize and thereby deactivate the tags 32 which are passed over the cover plate. Preferably, the magnetic field provided by the magnet assembly 34 above the cover plate 36 is strong enough to deactivate a tag 32 which is passed over the cover plate at a height of up to about ½" (1.3 cm), and preferably up to about one inch (2.5 cm) above the cover plate. If the magnet assembly 34 generates a magnetic field that cannot deactivate the tag 32 at a height of about ½" (1.3 cm), then there is a danger that the tag will not be deactivated as it is passed over the cover plate 36. And if the magnetic field provided by the magnet assembly 34 is too strong, there is a risk that the objects 30 to be purchased will be drawn down to the cover plate 36 if the objects are made of highly magnetically susceptible materials, such as steel or other ferrous materials. Such a strong attraction between the object 30 and the magnet assembly 34 beneath the cover plate 36 would slow down the check-out process.

In an alternative embodiment, the deactivator 35 can be installed on a conventional, pre-existing checkout counter 10 without installing the deactivator on the transition plate 18. Such a checkout counter may or may not have a conveyor belt 16. The deactivator 35 can be installed on any edge of the check-out counter that extends along the width of the counter, i.e., any edge that is perpendicular to the general motion of the objects 30 as they are passed over the laser scanner 20. Such an edge can be located either just before the scanner 20, or just after it. In this case, the C-shaped cross-section of the leading edge 42 of the cover plate 36 can be hooked onto the edge of the counter, as shown in FIG. 3, except that the counter has replaced the transition plate 18.

The deactivator 35 can be constructed by starting with a rectangular piece of non-magnetic steel and drawing it down into the desired shape of the cover plate 36. The magnets 38 are then epoxied to the underside of the cover plate 36. An optional filling material, such as Scotchcast TM opaque filler electrical resin No. 5, from 3M Company, St. Paul, Minn., can then be poured into the underside of the cover plate 36. A thin strip of double-sided pressure sensitive adhesive 40 is then applied to three of the four edges of the cover plate 36 (the fourth edge having the C-shaped cross-section 42 which is designed to hook around the transition plate 18). The deactivator 35 can then be installed on a given check-out counter having a transition plate by hooking the C-shaped cross-section of the cover plate 36 around the edge of the transition plate and adhering the three other edges of the cover plate to the transition plate with the double-sided pressure sensitive adhesive.

The deactivator 35 of the present invention can be easily installed in most conventional, pre-existing retail store check-out counters, including supermarket check-out counters. The present invention can be used in conjunction with either a magnetic or a non-magnetic transition plate, and can therefore be used with almost all pre-existing transition plates. Because the deactivator is installed on top of the transition plate, there is no need to remove the transition plate, making installation of the deactivator very easy. In the alternative embodiment, the deactivator 35 can be installed on a check-out counter which lacks a transition plate by simply hooking the cover plate 36 onto the counter itself.

The deactivator 35 has a very low profile and the cover plate 36 is designed to allow objects bearing tags to be passed easily over the deactivator. The total height of the deactivator 35 is only about ¼" (6.6 mm), equal to the thickness of the magnets 38, 0.225 inches, (5.7 mm) plus the thickness of the cover plate 36, 34 mils (0.9 mm).

The deactivator of the present invention is also advantageous in that it requires no complicated circuitry, no power source, and it never wears out. Furthermore, the deactivator will deactivate a tag moved across the cover plate less than about 7/8" (2.2 cm) above the plate regardless of how fast the tag is moved over the plate.

I claim:

1. A deactivator for magnetically altering a tag used in an electromagnetic article surveillance system, wherein the deactivator is adapted for use on a conventional, pre-existing check-out counter, wherein the deactivator includes:

an elongated cover plate having a length and width, adapted to be secured on an edge of the counter so that the length of the cover plate extends along the counter, the cover plate having a leading edge and a trailing edge extending along its length, wherein the leading edge has a C-shaped cross-section whereby the cover plate is configured to be hooked onto the counter edge along the length of the cover plate, and wherein the cover plate is configured to define a cavity therein extending along its length; and an elongated magnet assembly having a length and a width positioned within the cavity, the length of the magnet assembly extending substantially along the length of the cavity, wherein the magnet assembly provides a magnetic field above the cover plate, whereby the magnetic field is used to deactivate the tag secured to an object as the object is passed over the cover plate.

2. The deactivator of claim 1, wherein the cover plate is further secured to the counter by a double-sided pressure sensitive adhesive.

3. The deactivator of claim 1, wherein the magnet assembly includes a row of elongated magnets, each having a length and a width, having their lengths parallel to the length of the cover plate.

4. The deactivator of claim 1, wherein the magnet assembly provides a magnetic field above the cover plate that is sufficient to deactivate the tag as it is passed over the cover plate in a direction perpendicular to the length of the cover plate at a height of less than about 2.5 cm above the cover plate.

* * * * *